US005151247A

United States Patent [19]

Haglund et al.

[11] Patent Number: 5,151,247

[45] Date of Patent: Sep. 29, 1992

[54] HIGH PRESSURE ISOSTATIC DENSIFICATION PROCESS

[75] Inventors: Bengt O. Haglund, Älvsjö ; Bengt N. During, Upplands Väsby, both of Sweden

[73] Assignee: Sandvik AB, Sandviken, Sweden

[21] Appl. No.: 786,608

[22] Filed: Nov. 1, 1991

[30] Foreign Application Priority Data

Nov. 5, 1990 [SE] Sweden ..... 9003521

[51] Int. Cl.[5] ..... G22F 5/00

[52] U.S. Cl. ..... 419/13; 419/14; 419/15; 419/16; 419/17; 419/6; 419/47; 419/57; 419/60

[58] Field of Search ..... 419/13, 14, 15, 16, 419/17, 18, 47, 57, 60

[56] References Cited

U.S. PATENT DOCUMENTS

| | | | |
|---|---|---|---|
| 1,794,229 | 2/1931 | Hoyt | 119/18 |
| 3,532,493 | 10/1970 | Chay | 419/18 |
| 3,980,444 | 9/1976 | Reen | 419/47 |
| 4,032,336 | 6/1977 | Reen | 419/47 |
| 4,342,595 | 8/1982 | Bourdeau | 75/238 |
| 4,431,605 | 2/1984 | Lueth | 419/26 |
| 4,591,481 | 5/1986 | Lueth | 419/26 |
| 4,591,482 | 5/1986 | Nyce . | |
| 4,923,512 | 5/1990 | Timm et al. | 75/239 |
| 4,954,170 | 9/1990 | Fey et al. | 75/229 |

*Primary Examiner*—Stephen J. Lechert, Jr.
*Attorney, Agent, or Firm*—Burns, Doane, Swecker & Mathis

[57] ABSTRACT

The present invention is a method for densifying powder metallurgical parts to 100% theoretical density. The method comprises applying a high pressure of 0.1–100 MPa during sintering in a high pressure furnace at a temperature before which the liquid phase is formed and maintaining this pressure during the rest of the sintering cycle until the furnace has cooled to almost room temperature. The method achieves rapid, complete closure of the porosity which results in parts with close dimensional tolerances and practically no warpage.

9 Claims, No Drawings

HIGH PRESSURE ISOSTATIC DENSIFICATION PROCESS

BACKGROUND OF THE INVENTION

The present invention relates to a sintering process for liquid phase sintering of powder metallurgical parts, and the like, to close tolerances without warpage.

U.S. Pat. No. 4,431,605 describes a method for densifying previously sintered parts of powdered materials, etc. The parts may be sintered in either vacuum or hydrogen and may be cooled in a similar atmosphere. The parts are then reheated and the sintering vessel is pressurized to densify the parts.

AT 314212 discloses a method of sintering powder metallurgical parts according to which high pressure is applied after the eutectic temperature of the binder phase has been reached.

Complete densification is possible also without previous sintering. This process is advantageous with respect to dimensional tolerances and warpage of the sintered parts and it also necessitates much less time than the conventional two-step process.

When sintering powder metallurgical parts, the liquid phase, as soon as it is formed during the first heating, wets the solid particles rapidly and forms isolated pores within the structure which then is characterized by closed porosity. It has been found that a certain shrinkage occurs already during this heating. However, the remaining porosity and flaws still make the mechanical properties after cooling inferior compared to fully dense materials. In normal low-pressure sintering, final densification needs a long time for complete pore elimination, which occurs through vacancy diffusion and annihilation.

OBJECTS OF THE INVENTION

It is therefore an object of the present invention to avoid or alleviate the above-mentioned problems of the prior art.

It is further an object of this invention to provide a process for liquid phase sintering a powder metallurgical part to provide for essentially complete densification without warpage.

SUMMARY OF THE INVENTION

The present invention comprises a method of liquid phase sintering of powder metallurgical parts in a high pressure furnace comprising applying a pressure to the part of from about 0.1-100 MPa at a temperature below the formation of eutectic liquid phase, $T_{liq}$, and maintaining this pressure during the remainder of the sintering cycle until the part has been subjected to substantial cooling.

DETAILED DESCRIPTION OF THE PREFERRED EMBODIMENTS OF THE INVENTION

The present invention comprises a method in which porous powder metallurgical compacts, or the like, are placed inside a pressurizable vessel with a heating device. The compacts are heated in vacuum, inert gas or reducing protective atmosphere at approximately atmospheric or less pressure.

It has now been found that a high pressure in the order of 0.1 to 100 MPa, preferably 0.3-30 MPa, strongly accelerates the pore closure in a powder metallurgical part if the pressure is applied at a temperature which is lower, generally 2-50, preferably 5-30, most preferably 10-20, °C. lower, than that at which the liquid eutectic phase is formed, $T_{liq}$. The $T_{liq}$ temperature varies depending upon the material. Typically, said temperature is in the range of 1200° C.-1600° C. A higher pressure has to be used if the material to be sintered has a low content of liquid phase, <10 mol-% or fine grain size <1 μm. The pressure is maintained during the rest of the sintering cycle until the part has been subjected to substantial cooling, generally until the the furnace has cooled to almost room temperature or until it is cooled to at least 800° C. Alternatively, a pressure cycle with increasing or decreasing pressure may be used. The process of the present invention may be performed in a conventional high pressure furnace.

The invention applies in particular to powder metallurgical parts comprising at least one hard constituent comprising a carbide, nitride and/or carbonitride of at least one metal of groups IVB, VB and/or VIB of the Periodical System and a binder metal based on Co, Ni and/or Fe.

The explanation for the rapid pore closure is that the solid grains are forced by the external pressure to move into the most energetically favorable positions and this movement is strongly assisted by the low-viscosity binder phase. At the same time, the dissolution of carbide phase is facilitated thus forming still more binder phase which makes the final densification extremely rapid. It has also been found that the binder phase exhibits a typical pseudoplastic behavior in the temperature range in question.

Another effect that has been found, particularly in the case of cemented carbide, is that carburizing or decarburization reactions, which normally occur during conventional sintering, almost vanish. This effect is especially evident when higher pressure is applied, i.e., over 1 MPa and an inert gas such as argon is used as a pressurizing medium. As carburizing or decarburizing reactions generally are most pronounced between the parts and their support and these reactions influence on the specific volume of the sintered parts, they will cause severe warpage and loose tolerances. Application of inert gases at high pressure obviously suppresses such reactions, which together with the short sintering time results in practically no warpage and a safe production to very close tolerances.

It is extremely important that the pressurizing is made at the right temperature, i.e., before the temperature has been reached at which the liquid binder phase is formed. As this temperature is defined as the eutectic temperature at equilibrium, the pressurizing has to be made below this temperature. The eutectic temperature varies according to the composition and deviation from stoichiometric composition of a tungsten carbide-cobalt alloy. It is also known that this temperature is lower when the carbon content is high in the alloy than if it is low.

In a cemented carbide alloy consisting of only tungsten carbide and cobalt, the stoichiometric carbon content can be calculated from the formula:

$$\text{Carbon content(wt\%)} = 6.13(100\text{-\%Co})/100$$

In practice, there is often a carbon excess or deficiency with respect to the stoichiometric content according to the above formula. The difference may be called ΔC and may be several tenths of a percent, positive or negative, and is often intentionally used in the powder composition as a means for correction of the final sintered product composition to obtain specific properties.

According to the present invention, the starting temperature for pressurizing the sintering vessel must be in a temperature range of $T_{liq}-50$ to $T_{liq}-2$, preferably $T_{liq}-30$ to $T_{liq}-5$, most preferably $T_{liq}-20$ to $T_{liq}-10$, °C.

$T_{liq}$ can be determined experimentally, e.g., by differential thermal analysis (DTA).

For straight tungsten carbide-cobalt alloys, $T_{liq}$ can be calculated from the formula:

$$T_{liq}=(1314-456\Delta C)(\text{wt\%Co})^{(0.0015+0.0938\Delta C)}$$

If the alloy also contains other carbides such as of the fourth and fifth group of the transition elements in the Periodic Table of the elements, e.g., titanium carbide, niobium carbide and/or tantalum carbide, a corresponding correction to $T_{liq}$ has to be made. Generally, such correction terms are positive. Other elements, e.g., iron and nickel, form carbides of comparatively low stability and are generally alloyed in the binder phase. It is often found that $T_{liq}$ is lowered by such additions and the correction is thus negative.

To obtain a homogeneous temperature throughout the powder metallurgical parts to be sintered, it has been found beneficial to stop the temperature rise of the furnace as soon as the intended temperature for pressurizing has been reached in the surface of the compacts, but before pressurizing. The dwell time depends inter alia on the thinnest dimension of the compact, e.g., the thickness of a plate-shaped insert or the diameter of a long rod or the wall thickness of a tube or equivalent. If this dimension is called d (millimeters) the dwell time t (minutes) can be calculated from the formula:

$$t=15d^{178}$$

The method according to the present invention can also be used to deliberately change the carbon content of cemented carbide pieces using the improved transport capability of carbon reactive gases. For example, it may be necessary to correct the carbon balance obtained from initially used raw materials. Furthermore, the process can also be intentionally used to obtain requirements of mechanical or other physical properties of the sintered cemented carbide within narrow limits. If such corrections are necessary, carbon active gases such as hydrogen, methane, carbon monoxide, carbon dioxide, ammonia or water vapor may be used instead of inert gases or partly substituted for the inert gas.

Analogously, similar effects can be obtained in nitrogen-containing materials such as titanium carbonitride-based alloys by using nitrogen or nitrogen-containing gas mixtures or gaseous compounds as a reactive pressurizing medium. This is especially important as many nitrides tend to disproportionate at high temperatures and thereby lose their valuable high temperature properties.

Similar positive effects can be expected for all powder metallurgical materials that sinter in the presence of liquid phase such as SiAlONs and other silicon nitride-based materials, silicon carbide produced with liquid silicon as a sintering aid, ceramics with a metallic binder phase, heavy alloys, diamond-containing composites, etc.

The method according to the invention can also be used for the successful production of high speed steel according to powder metallurgy methods. The wear resistance of such materials can also be appreciably improved by mixing the high speed steel powder with wear resistant particles of, e.g., nitrides, such as titanium nitride or cubic boron nitride.

The invention is additionally illustrated in connection with the following Examples which are to be considered a illustrative of the present invention. It should be understood, however, that the invention is not limited to the specific details of the Examples.

Example 1

Inserts of different styles, types VBMM, CNMM and TNMG, were made from cemented carbide powders of two grades by uniaxial compaction to 55% relative density. The grades were:

| | Composition, weight % | | | |
|---|---|---|---|---|
| | Co | TiC | (Ta,Nb)C | WC |
| Grade I | 5.5 | 2.6 | 6.0 | Balance |
| Grade II | 10.2 | 1.9 | 3.9 | Balance |

Sintering experiments were performed in a high-pressure furnace according to the invention and in a similar furnace for conventional low pressure sintering. The dewaxing and presintering procedures were made to the same temperature and other process conditions. At 1290° C., the high pressure furnace was pressurized with argon to 1.75 MPa overpressure and then the heating was continued to 1450° C. After 30 minutes dwell time at this temperature, the furnace was cooled down and then depressurized. In the conventional sintering furnace, argon was purged at 1350° C. to only 4 kPa absolute pressure. The heating was then continued to 1450° C. Dwell time and cooling were made in analogy to the high pressure sintering furnace.

The sintered inserts were polished for metallographic examination and inspected for porosity according to ISO 4505. For both grades it was found that the high pressure sintered inserts according to the invention were absolutely pore free corresponding to A00 according to ISO 4505. On the other hand, the conventionally sintered inserts showed a porosity of A02, A04 or even worse in some instances for both grades.

Example 2

Test pieces for transverse rupture strength (TRS) determination were pressed to 55% relative density from powder of the two grades of Example 1. The test pieces were divided into two groups. One group was high pressure sintered according to the invention and the other group was conventionally sintered according to the conditions of Example 1. Testing of the transverse rupture strength was made according to ISO 3327. The following results were found:

| | Grade | TRS. $N/mm^2$ |
|---|---|---|
| Sintering according to the invention | I | 2380 |
| Sintering according to the invention | II | 3265 |
| Conventional sintering | I | 1780 |
| Conventional sintering | II | 2750 |

The comparison shows that the improvement in transverse rupture strength is 34% for grade I and 19% for grade II when sintering according to the invention.

Example 3

Test pieces for transverse rupture (TRS) determination were pressed to 55% relative density from powder of WC-6%Co with a carbon content of 5.61 weight-%. The test pieces were divided into two groups. One group was high pressure sintered according to the invention and the other group was conventionally sintered according to the conditions of Example 1. Density, porosity, $K_{IC}$ and hardness (HV10) were determined. The followinq results were found:

| | Density g/cm$^3$ | Porosity | $K_{IC}$ MPa m$^{\frac{1}{2}}$ | HV10 |
|---|---|---|---|---|
| Sintering according to the invention | 15.035 | A00 | 17.19 | 1566 |
| Conventional sintering | 15.012 | A06 | 14.62 | 1510 |

The comparison shows a considerable improvement in $K_{IC}$ of 18% for the grade when sintering according to the invention.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A method of liquid phase sintering of powder metallurgical parts in a high pressure furnace comprising applying a pressure to the part of from about 0.1–100 MPa at a temperature below the formation of eutectic liquid phase, $T_{liq}$, and maintaining this pressure during the remainder of the sintering cycle until the part has been subjected to substantial cooling.

2. The method of claim 1 wherein the said pressure is applied at a temperature in the range $T_{liq}-50$ to $T_{liq}-2°$ C.

3. The method of claim 1 wherein $T_{liq}$ occurs at a temperature of from about 1200° C.–1600° C.

4. The method of claim 3 wherein the said pressure is maintained during the sintering cycle until the furnace has been cooled to at least 800° C.

5. The method of claim 4 wherein the pressure is maintained until the furnace has been cooled to an ambient temperature.

6. The method of claim 1 wherein said powder metallurgical part comprises at least one hard constituent of a carbide, nitride and/or carbonitride of at least one metal of groups IVB, VB and/or VIB of the Periodic System and a binder metal based on Co, Ni and/or Fe, said high pressure is 0.3–30 MPa and the sintering is performed in an inert atmosphere.

7. The method of claim 1 wherein the atmosphere during sintering is a vacuum, inert gas or reducing gas.

8. The method of claim 1 wherein said powder metallurgical part consists of a grade of tungsten carbide and cobalt and the $T_{liq}$(°C.) is calculated from the formula $$T_{liq}=(1314-456\Delta C)(Wt\%Co)^{(0.0015+0.0938\Delta C)}$$

where ΔC is the difference between actual and stoichiometric carbon for the grade in weight-%.

9. The method of claim 1 wherein the powder metallurgical part is maintained at the temperature before pressurizing the furnace for a period of time, t, in minutes calculated by the formula $$t=15d^{\frac{1}{2}}$$

where d is the thinnest dimension of the part or equivalent in millimeters.

* * * * *